US006537080B2

(12) United States Patent
Sato

(10) Patent No.: US 6,537,080 B2
(45) **Date of Patent: *Mar. 25, 2003**

(54) JOINT CONNECTOR

(75) Inventor: Kei Sato, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,430

(22) Filed: Nov. 12, 1999

(65) Prior Publication Data

US 2002/0009925 A1 Jan. 24, 2002

(30) Foreign Application Priority Data

Nov. 13, 1998 (JP) ..... 10-324072

(51) Int. Cl.[7] ..... H01R 29/00

(52) U.S. Cl. ..... 439/43; 439/404; 439/516; 439/651; 439/695; 439/701; 439/717

(58) Field of Search ..... 439/48, 701, 695, 439/717, 404, 405, 651, 43, 49, 516

(56) References Cited

U.S. PATENT DOCUMENTS 4,322,120 A * 3/1982 Rilling ..... 339/47
4,384,757 A * 5/1983 Andrews, Jr. et al. ..... 339/258
RE32,898 E * 4/1989 Dechelette ..... 439/395
5,147,218 A * 9/1992 Matthew et al. ..... 439/404
5,286,225 A * 2/1994 Tsuji ..... 439/752

FOREIGN PATENT DOCUMENTS

JP 01-103168 7/1989

* cited by examiner

*Primary Examiner*—P. Austin Bradley
*Assistant Examiner*—Truc Nguyen
(74) *Attorney, Agent, or Firm*—Finnegan, Henderson, Farabow, Garrett & Dunner, L.L.P.

(57) ABSTRACT

A joint connector is provided with upper and lower housings and linkage terminals accommodated in the respective housings. Each linkage terminal comprises a plurality of terminals and carriers coupling the terminals. A plugging-in piece of each terminal projects below a bottom portion of each housing. A piece to be connected corresponding to the plugging-in piece is provided on each terminal. In the linkage terminal, a carrier(s) is cut off and a plugging-in piece(s) is fallen down according to a circuit configuration required. A connecting state between the terminals in one housing is cancelled by cutting the carrier. A connecting state between the terminals in the upper and lower housings is cancelled by bending the portion to be connected. Thereby, a required circuit pattern is set in the upper and lower housings.

10 Claims, 14 Drawing Sheets

JOINT CONNECTOR

BACKGROUND OF THE INVENTION

1. Field of the Invention

The present invention relates to a joint connector.

2. Description of the Related Art

As a conventional joint connector, there has been known a branch connector shown in FIG. 1 and disclosed in Japanese Utility Model Application Laid-Open (JU-A) No. 1-103168. In this branch connector, a plurality of conductors 1 are sandwiched between an upper case 2 and a lower case 3, connectors 5 are accommodated in connector insertion portions 4, and the connectors 5 are fitted in the connector insertion portions 4. The connectors 5 are respectively attached with wires 7, each wire 7 having one end with a U-shaped terminal 6.

When the connector 5 is inserted into the connector insertion portion 4, the terminal 6 of the one end of the wire 7 projects below the connector insertion portion 4 to be connected to a corresponding conductor 1 positioned at a predetermined position and sandwiched between the upper case 2 and the lower case 3.

As the connector 5, there are a rectangular tubular one illustrated in FIG. 1 and tubular ones with an upper large diameter portion and a lower small diameter portion illustrated in FIGS. 2A and 2B. Two connecting plates 6A, 6B integrally formed with a terminal 6 are provided in a connector 5A illustrated in FIG. 2A. Terminals 9A, 9B of conductors 8A, 8B are fitted to the connecting plates, 6A, 6B so that branching and/or connecting of a circuit is performed.

A connecting plate 6C integrally formed with the terminal 6 is provided in a connector 5B illustrated in FIG. 2B. A terminal 9C of a conductor 8C is fitted to the connecting plate 6C so that branching and connecting of a circuit are performed.

SUMMARY OF THE INVENTION

However, in the conventional joint connectors (branch connectors), a plurality of housing members such as the upper case 2, the lower case 3, the connectors 5 (5A, 5B) and the like are required and a plural kinds of the terminals 6 must be prepared, which results in increase in the number of parts. Accordingly, manufacturing, management and/or assembling work of these many parts are made complicated, so that it becomes difficult to reduce manufacturing cost.

In view of the above, an object of the present invention is to provide a joint connector at a low cost, which is reduced in the number of kinds of parts and has an excellent productivity, and whereby various circuit configurations can be assembled and secure connection can be performed.

In order to attain the above object, a joint connector of the present invention comprises upper and lower housings stacked, and conductive terminals respectively connected with wires. The terminals are accommodated in each housing. The terminals in each housing are arranged so as to be mutually connectable to one another. Each terminal has a portion to be connected extending upwardly and a connecting portion projecting below the housing. At least one of the connecting portion of the upper terminal and the portion to be connected of the lower terminal is bendable in a transverse or lateral direction. The terminals include an upper terminal in the upper housing and a lower terminal in the lower housing corresponding to the upper terminal. In a state where the housings are stacked at a predetermined position, when both of the connecting portion of the upper terminal and the portion to be connected of the lower terminal are not bent, the contacting portion comes in contact with the portion to be connected and the upper and lower terminals are connected in a conductive manner. In a state where the housings are stacked at a predetermined position, when at least one of the connecting portion of the upper terminal and the portion to be connected of the lower terminal is bent, the contacting portion is separated from the portion to be connected and conduction between the upper and lower terminals is shut off.

According to the above structure, a connecting portion of an upper terminal or a portion to be connected of a lower terminal is bent so that the upper and lower terminals are not connected in a state where upper and lower housings are stacked. Accordingly, various joint connectors can easily be designed according to various circuit configurations.

The terminals may be formed integrally in a multi-connected manner as a linkage connector, which has been cut out from a mother plate.

According to the above structure, by using a linkage terminal where terminals having the same pattern are formed in a multi-continuous shape, it is possible to obtain various circuit configurations, which result in improvement in productivity.

The linkage terminal may include a strip-shaped carrier coupling the terminals and a front end portion perpendicular to the carrier and extending in its longitudinal direction to be bent back. The portion to be connected is arranged at a distal end portion of the front end portion so that it may be erected from the bent-back front end portion.

According to the above structure, a developed terminal has a narrow elongated shape. Accordingly, a space or interval between adjacent terminals in the same linkage terminal can be made small, so that an area of a mother plate to be wasted can be reduced, which results in improvement in yield.

The connecting portion may be constituted with a connecting plate, and the portion to be connected may be constituted with spring pieces sandwiching or holding the connecting portion therebetween.

According to the above structure, as a connecting portion is formed in a plate shape, it can easily be bent. Also, in a state where a connecting plate or piece has not been bent, the connecting plate is held between spring pieces of a portion to be connected of a lower terminal so that the upper and lower terminals are connected to each other.

Each housing may have openings and the connecting portions in one housing may pass through the openings in the one housing. Each housing may have protection walls which are formed at peripheral edges of the openings and which project below the connecting portions which have passed through the openings. Also, in a state where the housings are stacked at a predetermined position, the protection wall of the upper housing may be opposed to the bent portion to be connected of the lower terminal.

According to the above structure, a protection wall prevents a connecting portion of an upper terminal from deforming to protect the connecting portion. In a state where a portion to be connected of a lower terminal has been bent, the protection wall of an upper housing prevents the bent portion to be connected from being erected so that a connection between the connecting portion and the portion to be connected is securely prevented.

The joint connector may be provided with engaging means for holding the housings in the state where the housings have been stacked at the predetermined position.

According to the above structure, upper and lower housings are fixed at a predetermined position by engaging mean. When a portion to be connected of a lower terminal has been bent, the upper and lower housings are held by the engaging means, so that the portion to be connected is securely prevented from being erected.

Each terminal may have wire holding pieces for holding the wire. The wire holding pieces may be disposed at both side portions of terminals so as to be shifted from each other in a longitudinal direction of each terminal.

According to the above structure, as wire holding pieces are shifted from each other in a longitudinal direction of a terminal, a space between adjacent terminals belonging to the same linkage terminal can be made small, which results in improvement in yield.

DESCRIPTION OF THE PREFERRED EMBODIMENTS

Figure 1:
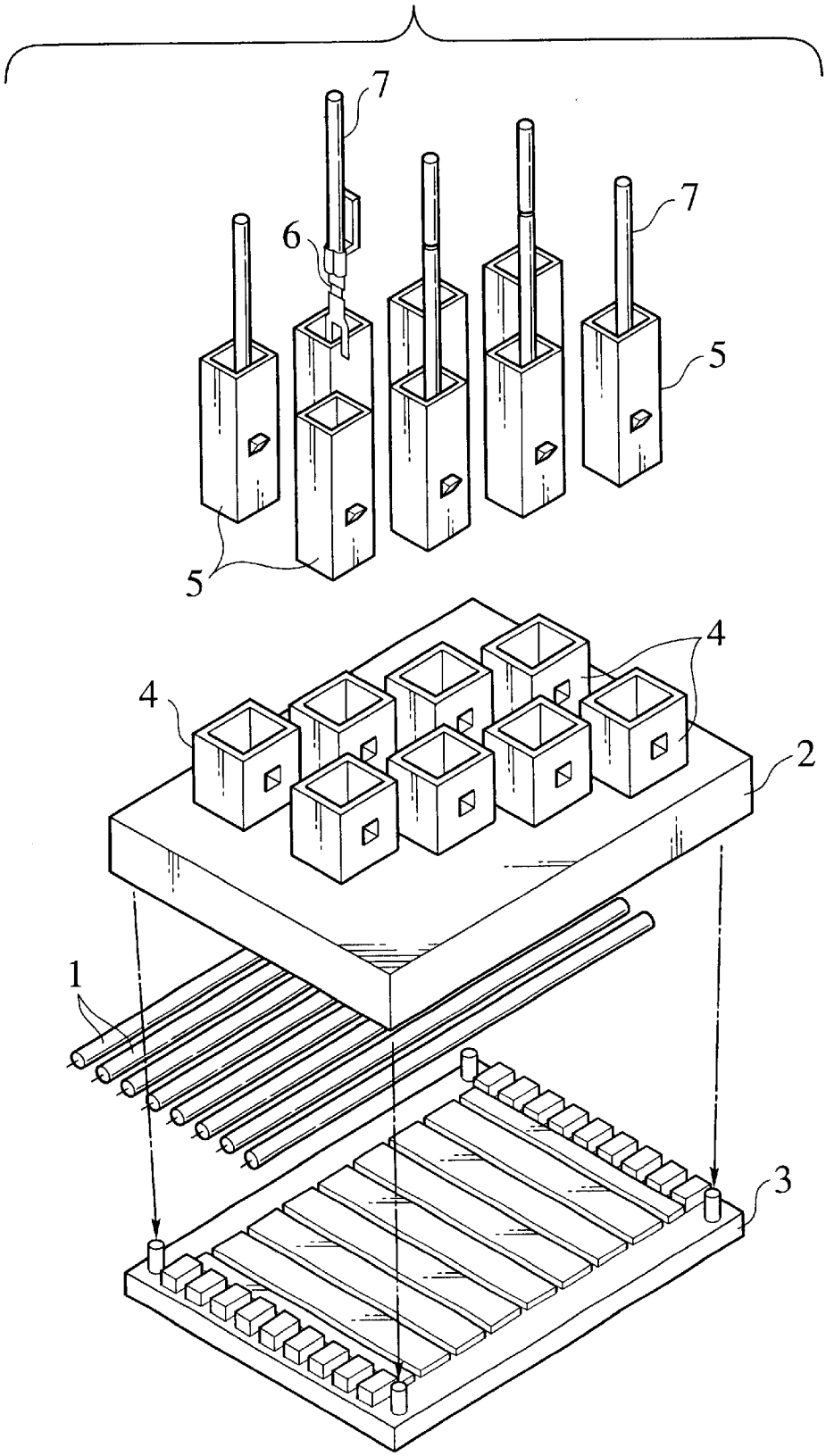
FIG.1 PRIOR ART
FIG. 1 is an exploded perspective view illustrating a conventional joint connector (branch connector)
Figure 2A:
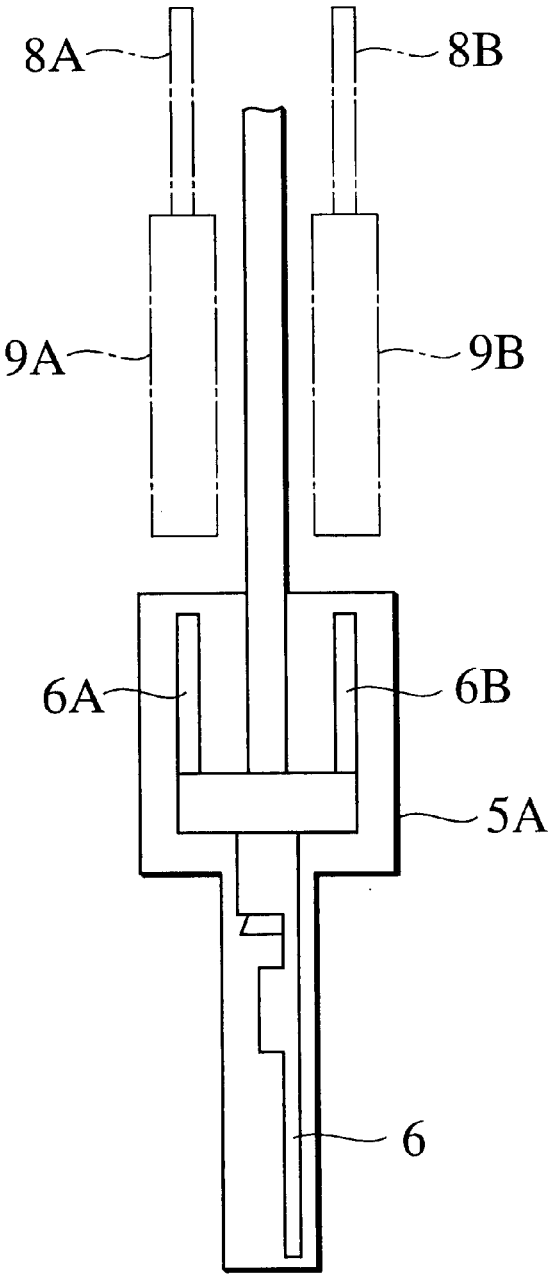
FIG.2A PRIOR ART
FIG. 2A is a sectional view illustrating a conventional joint connector.
Figure 2B:
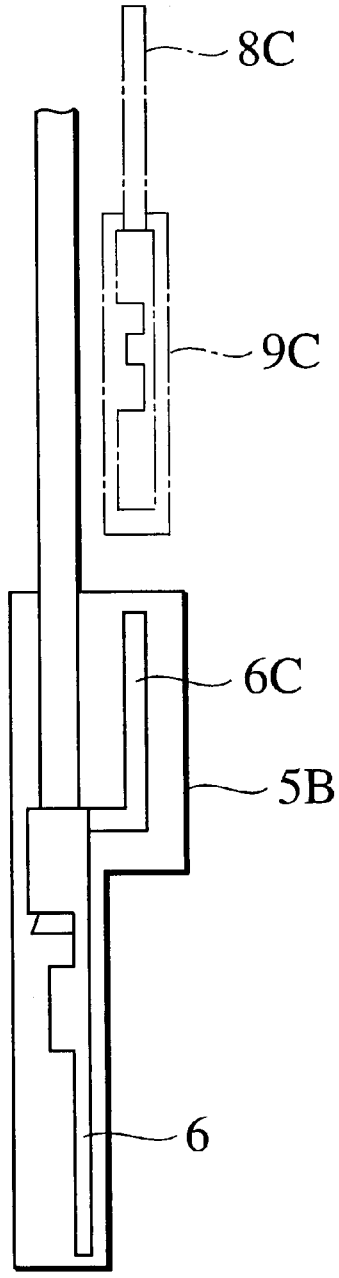
FIG.2B PRIOR ART
FIG. 2B is a sectional view illustrating another conventional connector.

A joint connector according to the present invention will be explained in detail with reference to respective embodiment illustrated in the drawings below.

First Embodiment

FIGS. 3 to 13 illustrate a first embodiment of the joint connector according to the invention.

Figure 3:
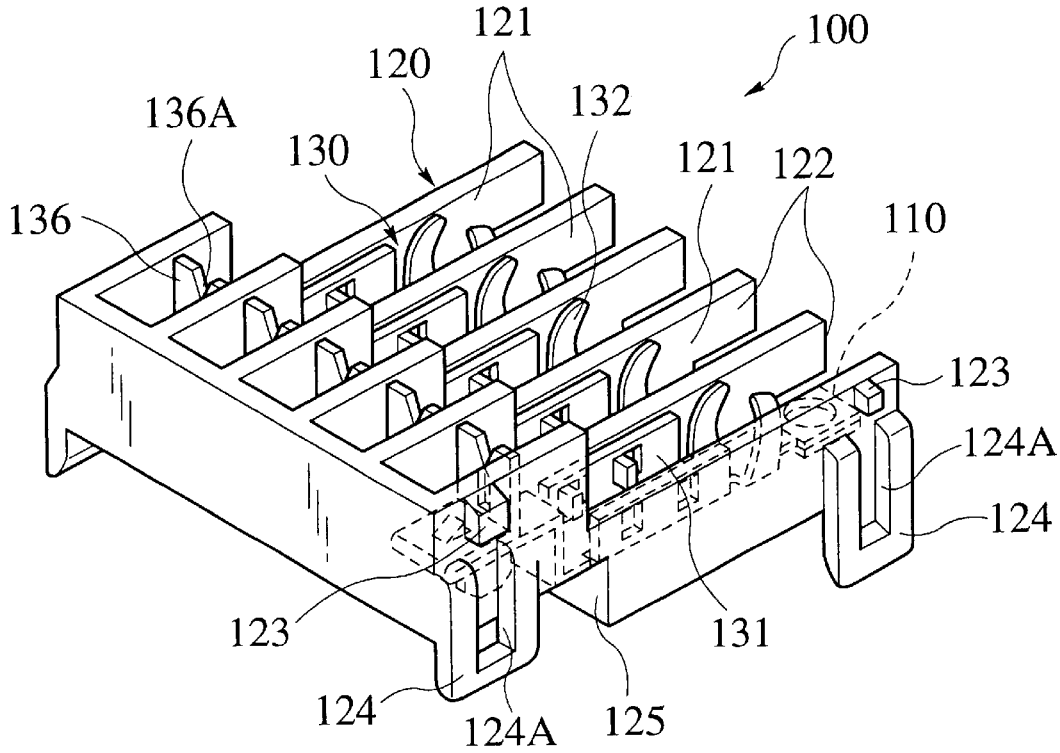
FIG. 3 is a perspective view illustrating a module in a first embodiment of a joint connector according to the present invention.

FIG. 3 illustrates a module 100 of the joint connector of this embodiment. The module 100 comprises a linkage terminal 110 and a housing 120 accommodating the linkage terminal 110.

Figure 4:
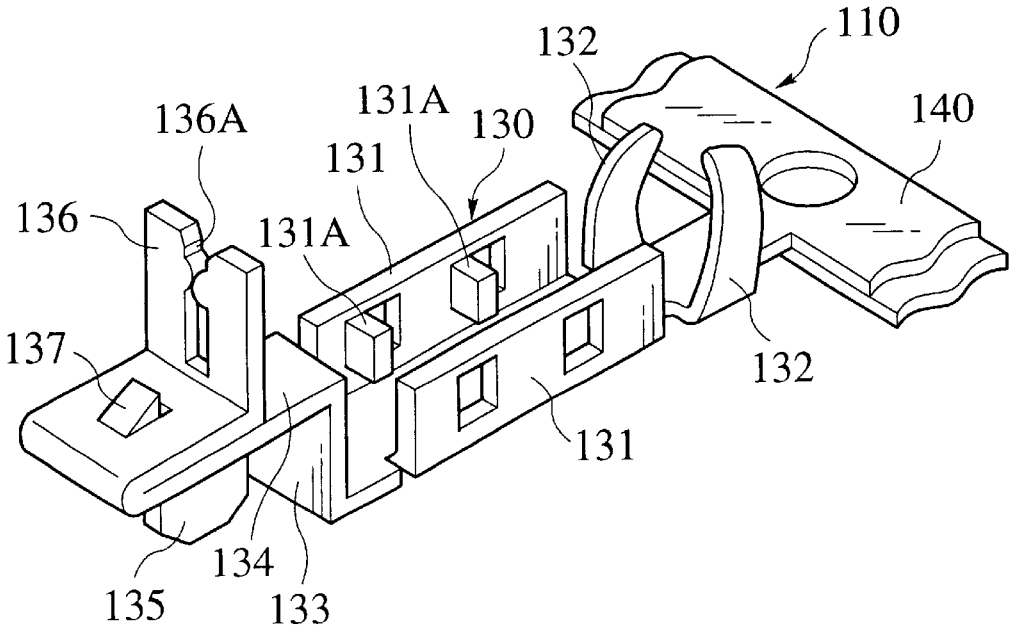
FIG. 4 is a perspective view explaining the module in the first embodiment according to the present invention.

As illustrated in FIG. 4, the linkage terminal 110 is provided by working a metal plate. The linkage terminal 110 comprises a plurality of terminals 130 arranged in parallel and carriers 140 connecting the terminals 130. The terminals 130 are connected via the carriers 140 in a multi-continuous manner.

As illustrated in FIG. 3, formed in the housing 120 made of resin material are accommodation grooves 121 partitioned by partition walls, 122 and arranged in parallel. The respective accommodation grooves 121 correspond to the respective terminals 130 belonging to one linkage terminal 110, each terminal 130 has a wire holding portion holding a wire.

Two protrusions 123 for module engagement are formed at an upper portion of each of a pair of outside faces of the housing 120 opposed to each other. Locking pieces 124, 124 for engagement extend downwardly from portions of the outside face positioned below the protrusions 123 for module engagement. An opening 124A into which a protrusion 123 for module engagement of another housing 120 is formed in each engaging lock piece 124.

Figure 5:
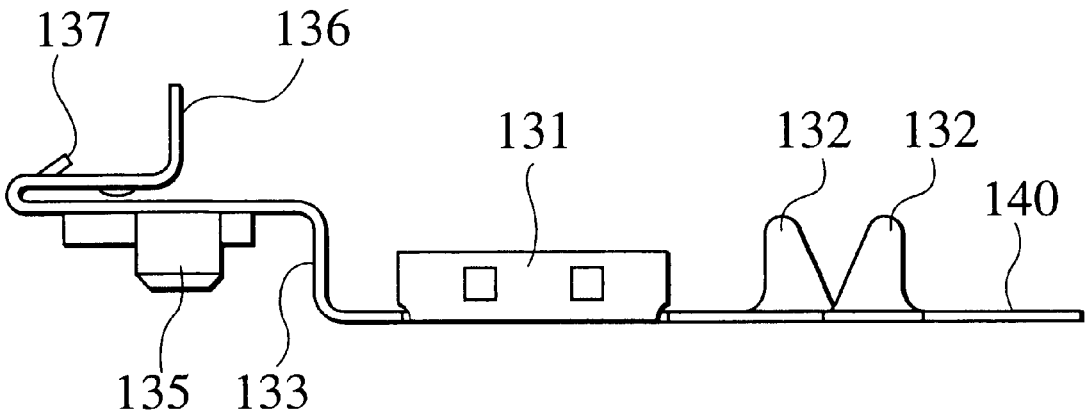
FIG. 5 is a side view of the terminal in the first embodiment.

Next, the structure of the terminal 130 constituting the linkage terminal 110 will be explained with reference to FIG. 4. A pair of wire press-fitting plates 131, 131 erected from both side portions of the terminal 130 are formed on an intermediate portion, in a longitudinal direction, of the terminal 130. Wire press-contacting pieces 131A, 131A are erected in a cutting manner on each wire press-fitting plate 131. Bending pieces 132 erected from both side portions of the terminal 130 are formed at an intermediate portion between the wire press-fitting plates 131 and the carrier 140. As shown in FIG. 5, two bending pieces 132, 132 are arranged so as to be shifted in a longitudinal direction of the terminal 130.

A standing piece 133 along a standing wall 125 of the housing 120 is disposed nearer to a distal end side than the wire press-fitting plates 131. A horizontal plate portion 134 extending forward, is formed at an upper portion of the standing piece 133. A plugging-in piece 135 for connection bend downwardly and serving as a connecting portion is formed on the horizontal plate portion 134. A piece 136 to be connected which is bent upwardly to be erected by a predetermined distance and which serves as a portion to be connected is formed on the horizontal plate portion 134.

Figure 6:
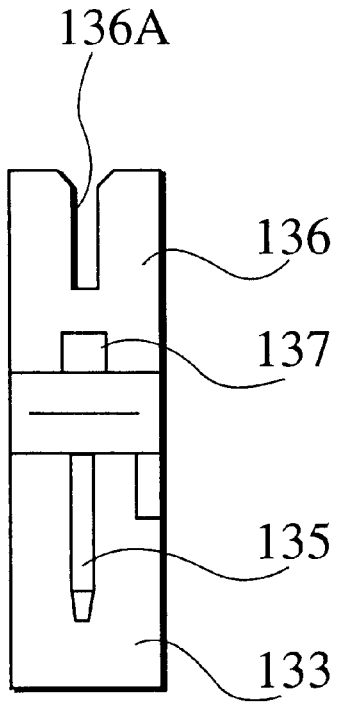
FIG. 6 is a front view of the terminal in the first embodiment in the first embodiment.

As illustrated in FIG. 6, a slit 136A is formed in the piece 136 to be connected. The plugging-in piece 135 can be plugged in the slit 136A. A protrusion 137 for engagement extending obliquely upward and rearward is disposed in front of the piece 136 to be connected.

Figure 9:
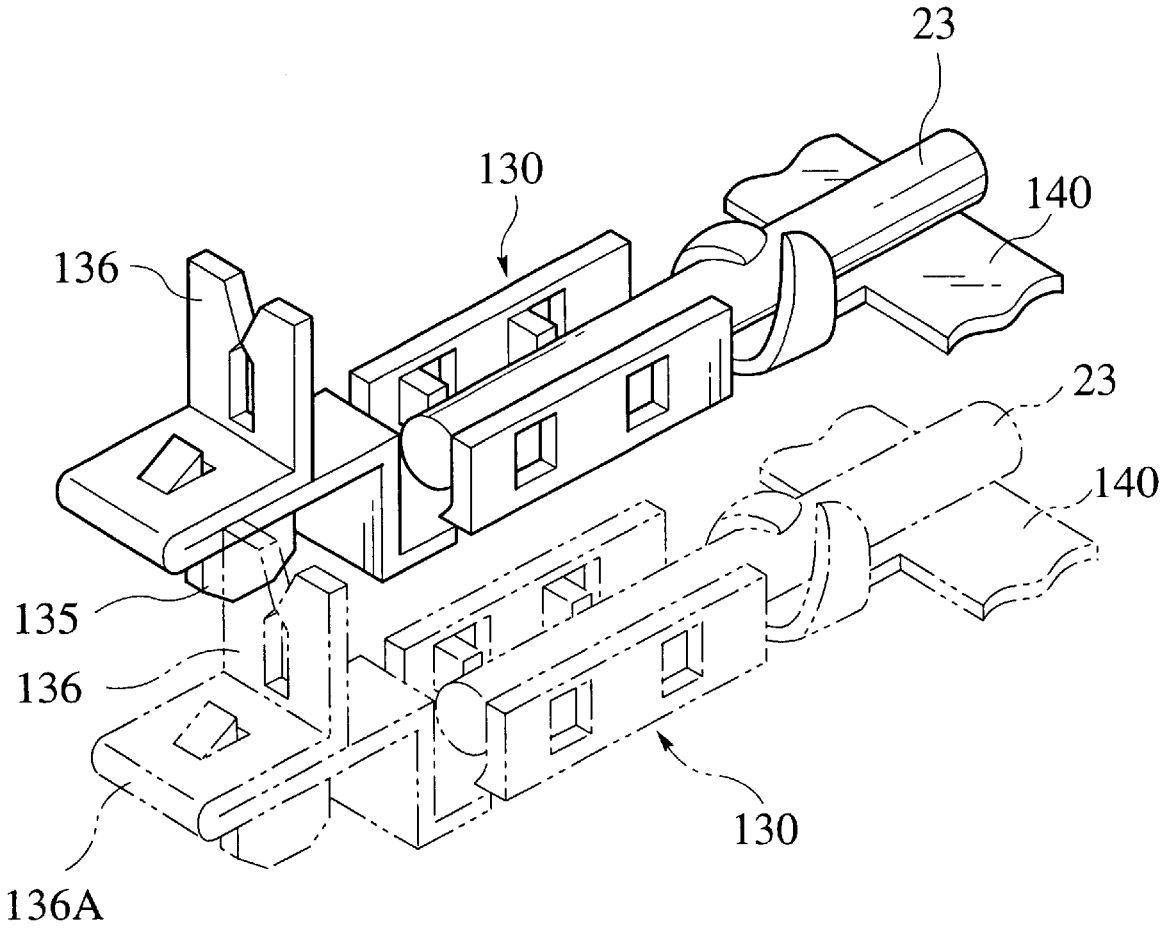
FIG. 9 is a perspective view illustrating a state where terminals of the first embodiment are connected to each other.

As illustrated in FIG. 9, in order to connect a wire to the terminal 130, a conductive wire (not shown) is press-fitted between the wire press-fitting plates 131, 131 to be connected to the wire press-contacting pieces 131A. Then, a portion of the wire 23 which is covered with an insulating cover is disposed between the bending pieces 132 and the wire 23 is fixed to the terminal 130 by bending the bending pieces 132.

Slits (not shown) serving as openings are formed in the housing 120 accommodating the linkage terminal 110 comprising the terminals 130 connected in a multi-continuous manner. The plugging-in piece 135 of each terminal 130 passes through each slit. The plugging-in piece 135 which has passed through the slit projects downward from a lower face of the housing 120.

Figure 7:
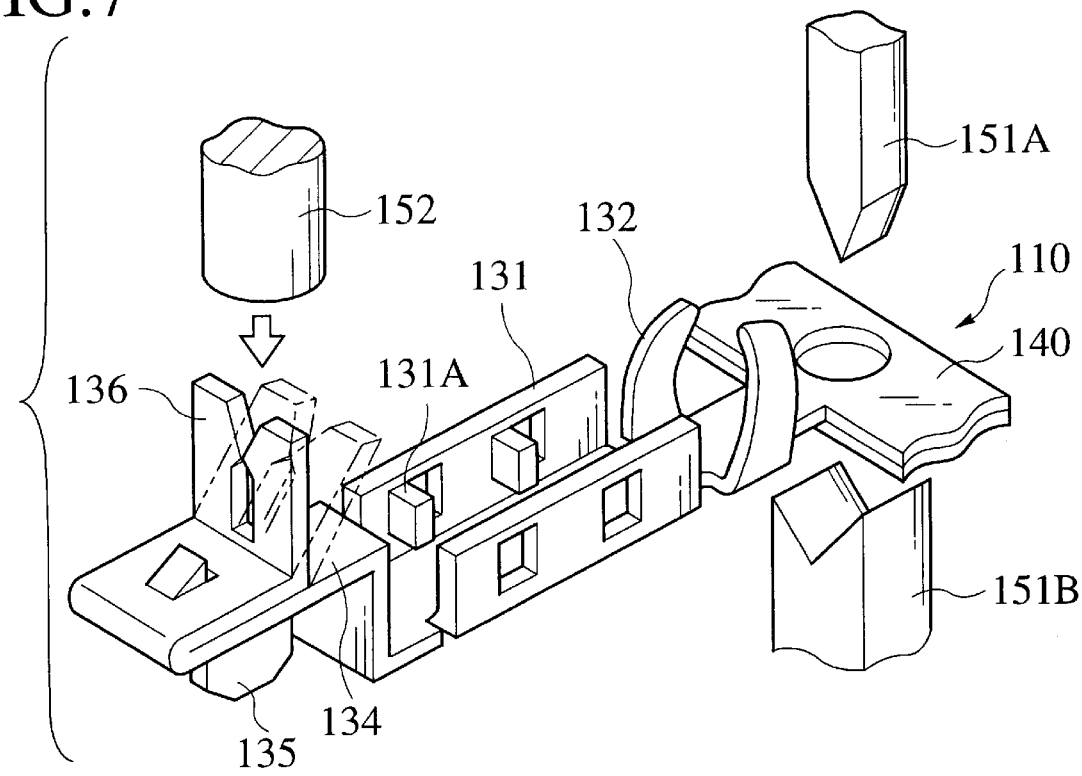
FIG. 7 is a perspective view illustrating how to work a linkage terminal of the first embodiment performed by a jig.

As illustrated in FIG. 7, in order to separate the multi-continuous linkage terminal 110 into individual terminals 130 according to a connection circuit configuration required, after the linkage terminal 110 is accommodated in the housing 120, carrier cutting jig 151A and 151B are pushed on the carrier 140 and the carrier 140 is cut off by the jigs 151A and 151B.

Figure 8:
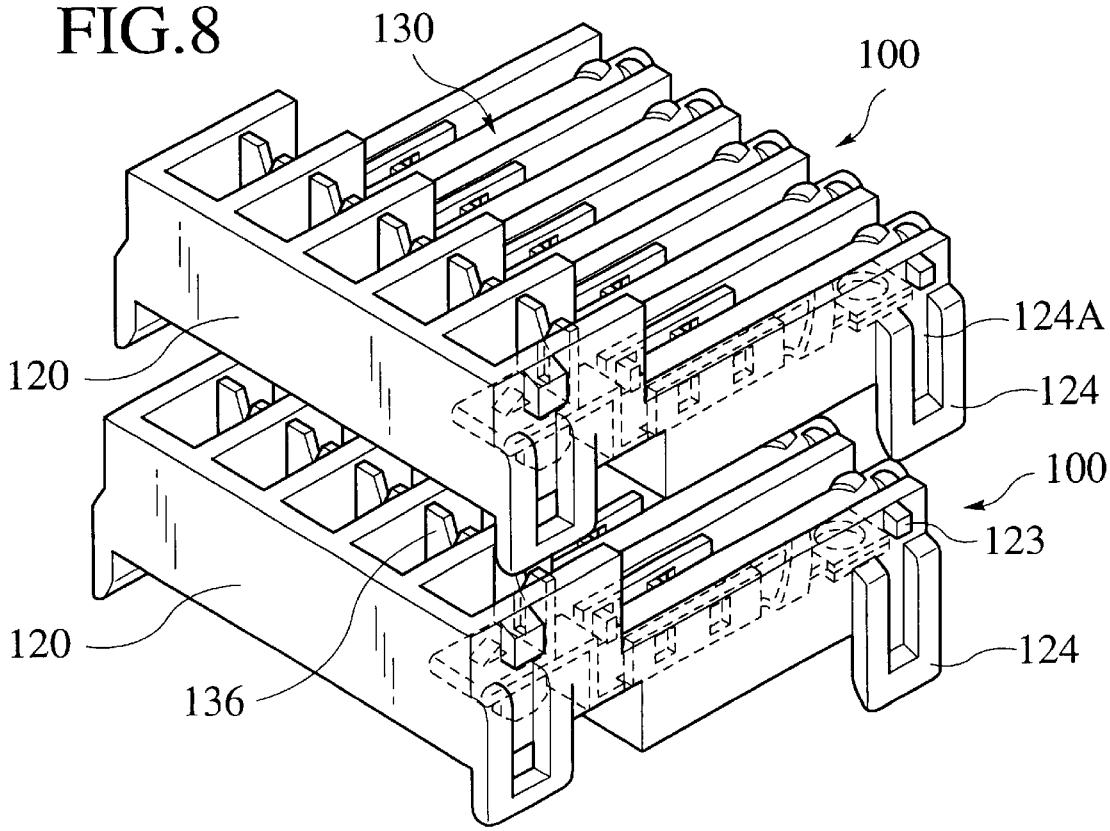
FIG. 8 is a perspective view illustrating a state where the modules of the first embodiment are connected to each other.

When the modules 100 each having the housing 120 accommodating a plurality of the terminals 130 are stacked and a connection between the upper and lower modules is performed, and there is one of pairs of corresponding upper and lower terminals 130, 130 where connection between the corresponding upper and lower terminals 130 are not required, the piece 136 to be connected of the lower terminal 130 of the pair of the corresponding upper and lower terminals 130 whose connection is not required is fallen down by using such a bending jig 152, as illustrated in FIGS. 7 and 8.

As illustrated in FIG. 8, in order to stack the modules 100 vertically, each module 100 having the housing 120 accommodating a plurality of the terminals 130, a plurality of the modules 100 are stacked one on another in a state where a wire has been connected to each terminal 130 in each housing 120. Then, the protrusions 123 for module engagement of the lower housing 120 are fitted into the openings 124A of the locking pieces 124 for engagement of the upper housing 120. Thereby, the upper and lower modules 100 are locked to each other in a stacked state.

At this time, as illustrated in FIG. 9, the plugging-in piece 135 of the terminal 130 of the terminals in the upper housing 120 which is required to be electrically connected to a corresponding terminal 130 in the lower housing 120 is plugged in the slit 136A of the piece 136 to be connected of the corresponding terminal 130 in the lower housing 120 so that corresponding terminals 130 in the upper and lower housings 120 are electrically connected to each other.

Figure 12:
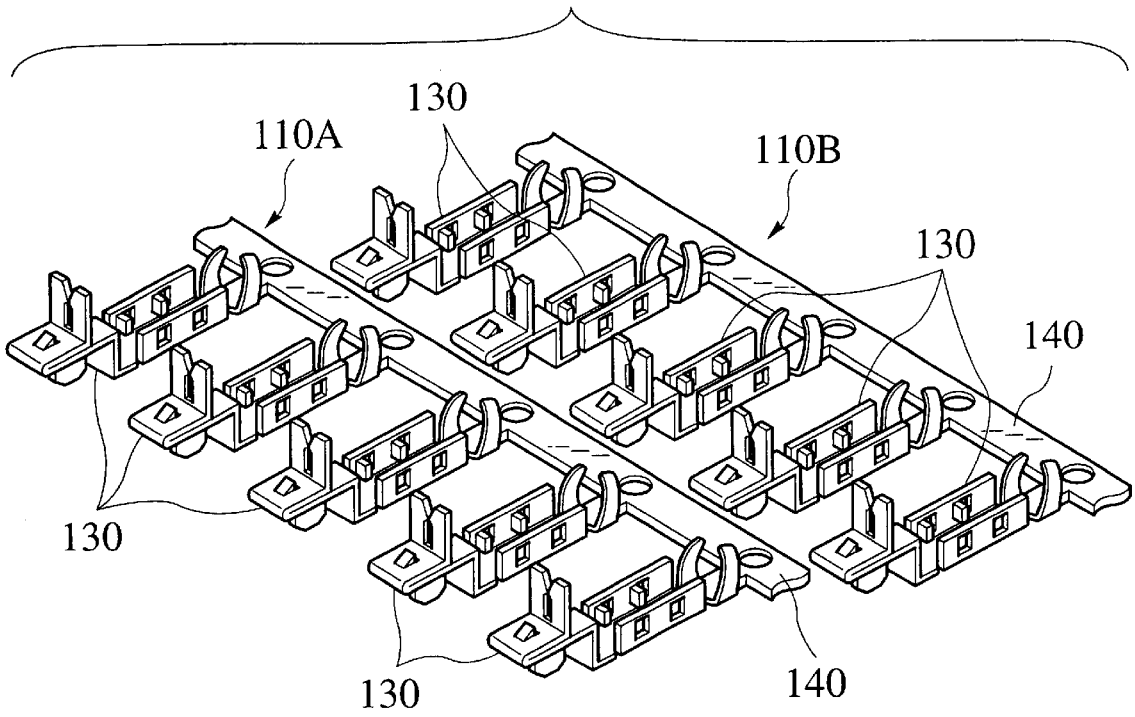
FIG. 12 is a perspective view illustrating the linkage terminal in the first embodiment.
Figure 13:
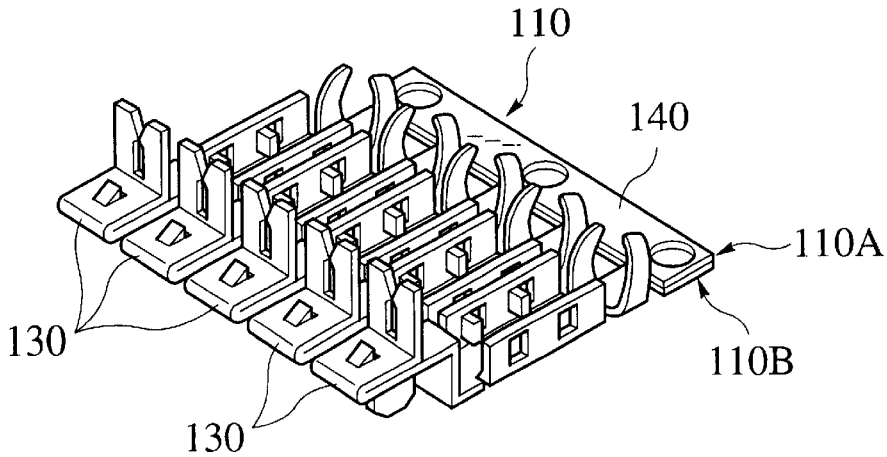
FIG. 13 is a perspective view illustrating the linkage terminal in the first embodiment.
Figure 14:
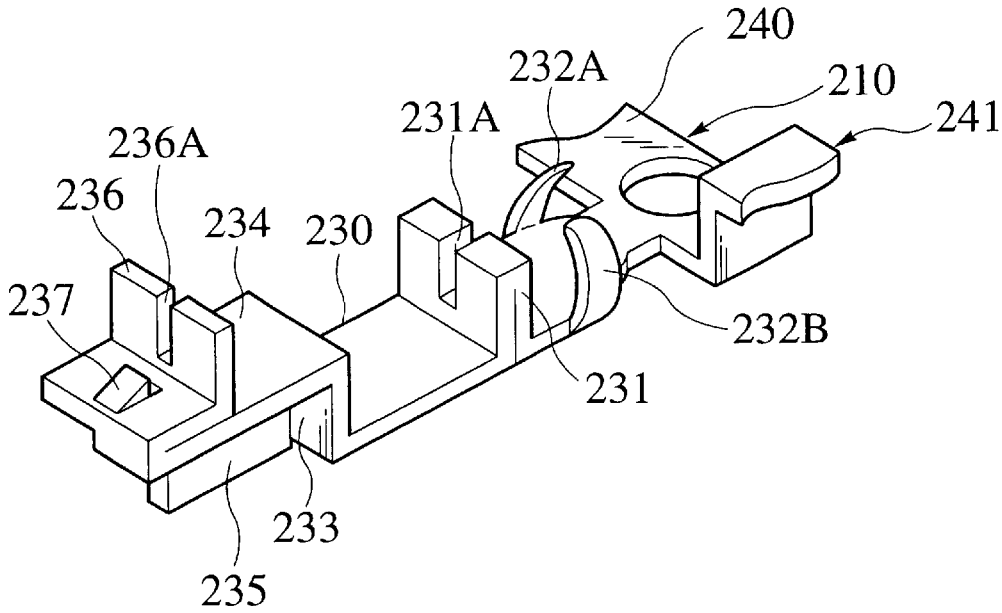
FIG. 14 is a perspective view illustrating a terminal in a second embodiment of the joint connector according to the invention.

Incidentally, the linkage terminal 110 used in this embodiment is constituted by combining two linkage terminals 110A, 110B as illustrated in FIG. 12 in such a manner as illustrated in FIG. 13. That is, the carriers 140 are stacked and welded to each other in a state where the terminals 130 of the linkage terminal 110A and the terminals 130 of the linkage terminals 110B have been arranged in a staggered manner. The carriers 140 of the linkage terminal 110 can properly be cut according to the housing 120 used.

In the present embodiment, as illustrated in FIGS. 12 and 13, in a state where the linkage terminal 110A and the linkage terminal 110B have been shifted by half of a pitch between adjacent terminals 130 along longitudinal directions of the carriers 140 and they have been stacked one on another, the upper and lower carriers 140 have been welded to each other. Particularly, in this embodiment, as apparent from a developed state of the terminal 130 illustrated in FIG. 11, the piece to be connected 136 can be obtained by bending back the terminal 130 from a state of the terminal 130 extending in its longitudinal direction and erecting the same. For this reason, the terminal 130 is formed in an elongated shape having a small width. Accordingly, an interval between adjacent terminals 130 can be made small and an area of a mother plate wasted can be reduced, which results in improvement in yield.

Figure 10:
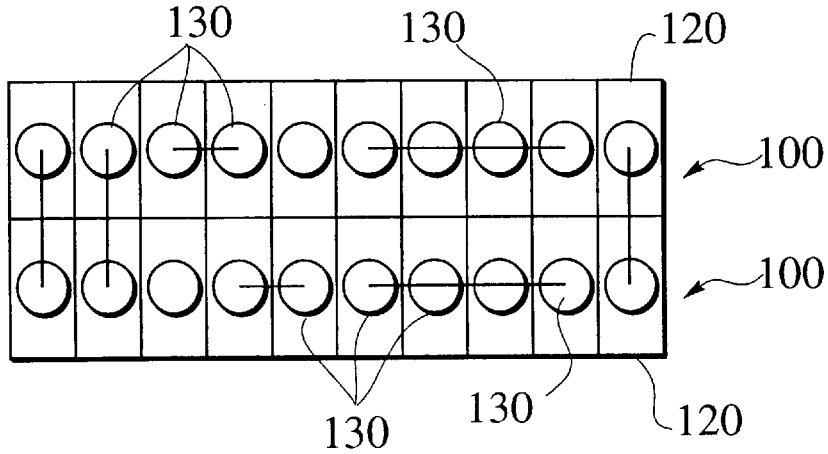
FIG. 10 is an explanative view illustrating one example of connection structure where the modules of the first embodiment are used.
Figure 11:
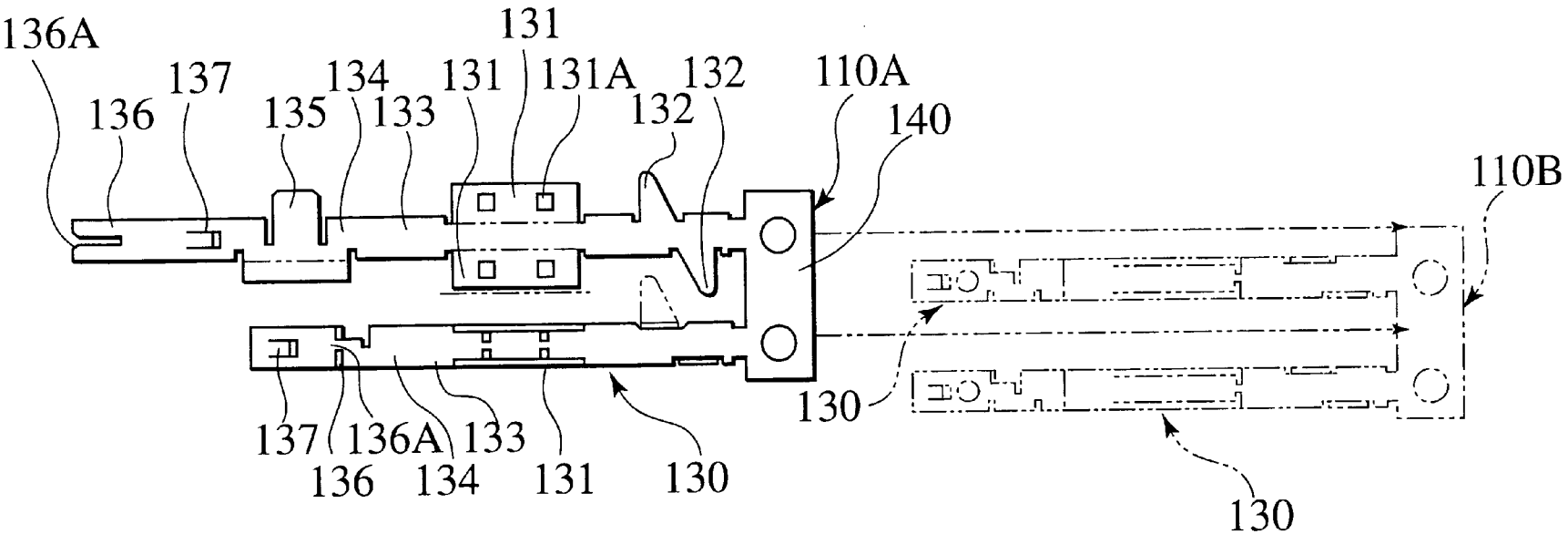
FIG. 11 is a plan explanative view of the linkage terminal of the first embodiment.

In the above, the structure of the module 100 of the joint connector of the first embodiment has been explained, but, for example, a connection structure such as illustrated in FIG. 10 can be obtained by using such a module 100. In FIG. 10, the housings 120 and the terminals 130 have been shown in an illustrative manner.

In FIG. 10, a portion where the terminals 130 have been connected transversely by a transverse or horizontal line shows a state where the carrier 140 between the terminals arranged in a transverse direction has not cut off, while a portion where the terminals 130

Also, a portion where the terminals 130 have been connected by a vertical line shows a state where the plugging-in piece of the upper terminal 130 has been inserted in the slit 136A of the connecting piece 136 of the lower terminal 130. A portion where the terminals 130 have not connected by a vertical line shows a state where the piece 136 to be connected of the lower terminal 130 has been fallen down.

Thus, cutting-off of the carrier 140 of the terminals 130 and/or falling-down of the pieces to be connected is effected according to a circuit configuration required, and connecting and/or branching of wires can arbitrarily be set by stacking the modules 100 of a required number.

In the above, the explanation has been given of the first embodiment. In this embodiment, the carrier(s) 140 of the terminals 130 is cut and/or the piece(s) 136 to be connected is fallen down, and the required number of the modules 100 are stacked so that wire connecting and/or wire branching can be set as required.

Also, the terminal 130 of the present embodiment can be formed by bending an elongated metal plate extending in front and rear directions at proper portions along its front and rear directions, so that a member for the terminal 130 is not required to spread in its widthwise direction and the metal plate which is a mother plate can be effectively utilized, which results in improvement in yield.

Second Embodiment

FIGS. 14 to 17 illustrates a second embodiment of the joint connector according to the invention.

Terminals 230 used in the joint connector of the present invention are formed in parallel on a linkage terminal 210. A conductive wire press-fitting portion 231 bent upwardly in an overlapping manner and having a slit 231A at a central portion is formed in an intermediate portion, in a longitudinal direction (front and rear directions), of each terminal 230 by bending work. Bending pieces 232A, 232B erected at both side portions of the terminal are disposed in an intermediate portion between the conductive wire press-fitting portion 231 and a carrier 240.

A horizontal plate portion 234 extending forward via a standing plate portion 233 is formed nearer to a distal end side than the conductive wire press-fitting portion 231. A plugging-in piece 235 for connection bend downward and serving as a connecting portion is formed on the horizontal plate portion 234. A piece 236 to be connected which is folded back from a front end and erected and which serves as a portion to be connected is formed on the horizontal plate portion 234.

A slit 236A extending from an upper portion of the piece 236 to be connected towards a lower portion thereof is formed at a central portion of the piece 236 to be connected. An engaging projecting piece 237 projects from a portion ahead of the piece 236 to be connected, obliquely rearward and upward. Incidentally, a generally U-shaped bent portion 241 is formed on each carrier 240 so as to ride over a partition wall 221 of a housing 220 described later.

Figure 16:
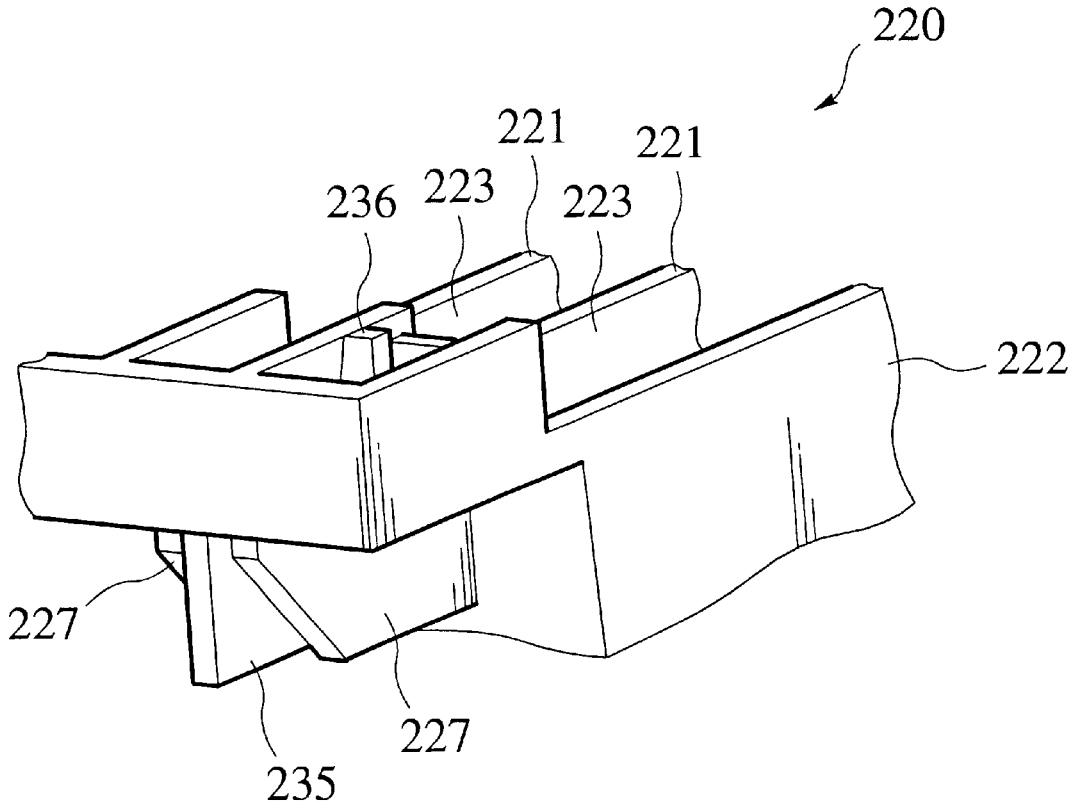
FIG. 16 is a perspective view illustrating a state where a housing and a terminal have been assembled in the second embodiment.

As illustrated in FIG. 16, the housing 220 includes a plurality of accommodation grooves 223 partitioned by a plurality of the partition walls 221 and side walls 222. Each terminal 230 is inserted in each accommodation groove 223. At front ends of the respective accommodation grooves 223, standing walls 224 and horizontal walls 225 are formed so as to correspond to the standing plate portions 233 and the horizontal plate portions 234 of the respective terminals 230.

Figure 15:
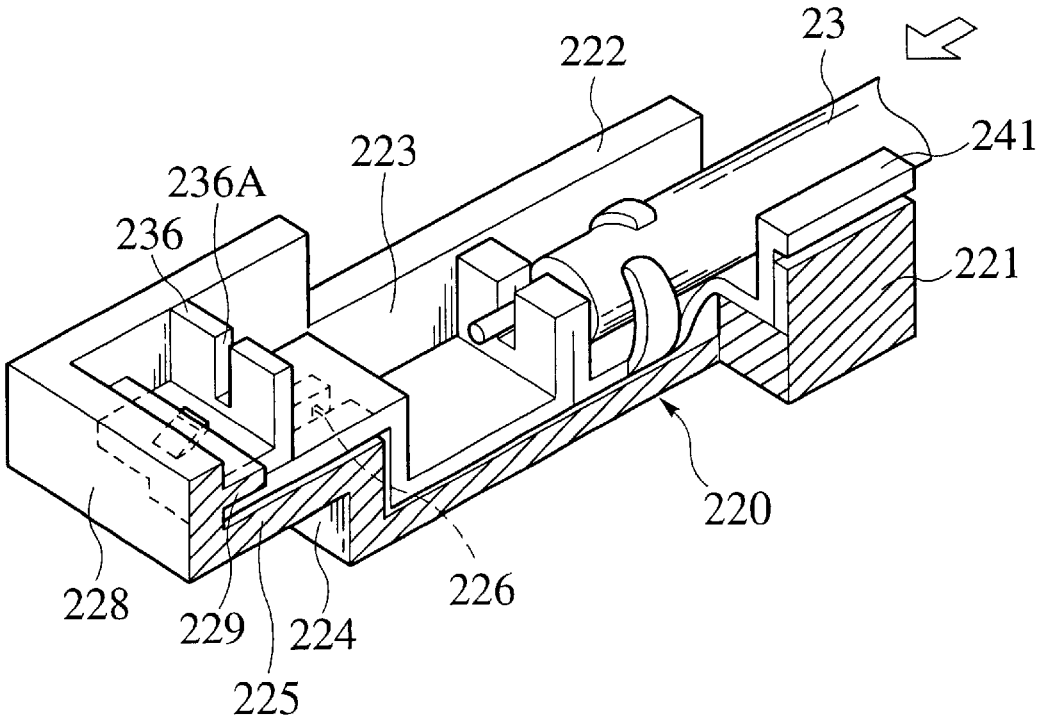
FIG. 15 is a partially sectioned perspective view illustrating the second embodiment.

A slit 226 in which the plugging-in piece 235 is inserted when the terminal 230 is inserted into the accommodation groove 223 from a direction indicated by arrow shown in FIG. 15 is formed in the standing wall 224 and the horizontal wall 225. The plugging-in piece 235 which has been inserted into the slit 226 is exposed below the front end of the housing 220, as illustrated in FIG. 16.

Protection walls 227 are formed on both sides of the slit 224 so as to extend below the lower end of the plugging-in piece 235 which has been inserted in the slit 224. A front end lower portion of each protection wall 227 is formed in a tapered shape such that the protection wall 227 does not prevent a front end lower portion of the plugging-in piece 235 from being connected to another terminal 230. Furthermore, a front end of the horizontal wall 225 constitutes a front side wall 228. An engaging wall 229 having a hole engaged with the engaging protrusion piece 237 of the terminal 230 is formed inside the front side wall 228.

Figure 17:
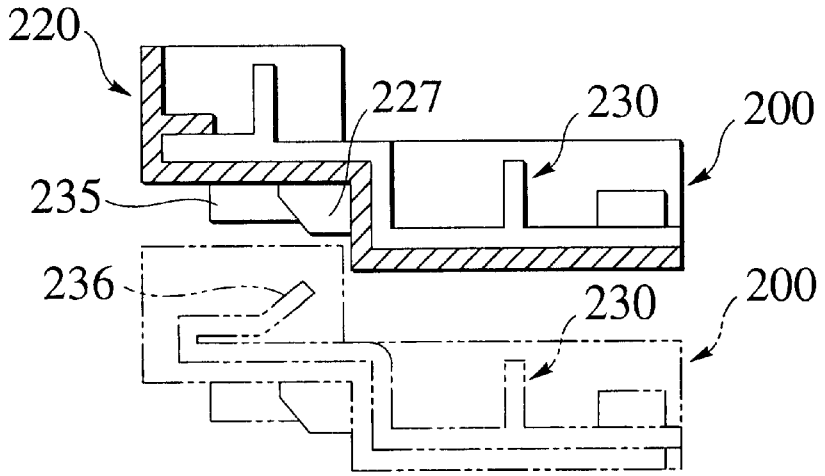
FIG. 17 is an explanative view illustrating how to assemble upper and lower modules in the second embodiment.

The terminals 230 of the linkage terminal 210 is mounted in the housing 220 so that the module 220 serving as the joint connector of the present embodiment is constituted. As illustrated in FIG. 17, the modules 200 are stacked on each other in a state where the piece 236 to be connected of one of the terminals 230 in the lower housing 220 which is not required to be electrically connected to corresponding one of the terminals 230 in the upper housing 220 has been fallen down. Thereby, the piece 236 to be connected which has been fallen down is pressed by the protection walls 227 of the upper housing 220. Accordingly, the connecting plugging-in piece 235 of the upper terminal 230 and the piece 236 to be connected which has been fallen down are prevented from coming in contact with each other.

Also, as the plugging-in piece 235 is protected by the protection walls 227, the plugging-in piece 235 is prevented from deforming.

Third Embodiment

FIGS. 18 to 22 illustrate a third embodiment of the joint connector according to the present invention.

Figure 18:
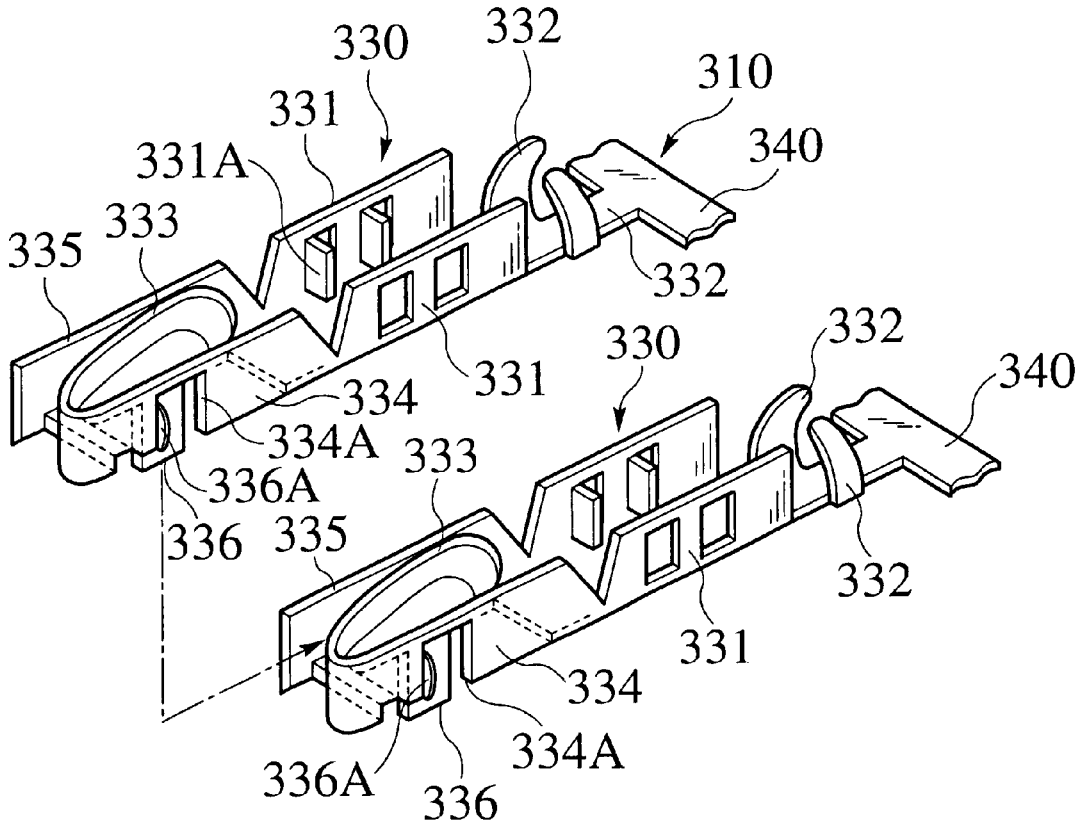
FIG. 18 is a perspective view illustrating the linkage terminals in the second embodiment.

As illustrated in FIG. 18, a linkage terminal 310 is provided by working or processing a metal plate. The linkage terminal 310 comprises a plurality of terminals 330 arranged in parallel and a carrier 340 connecting the terminals 330. The terminals 330 are connected in a multi-continuous manner via the career 340.

Figure 21:
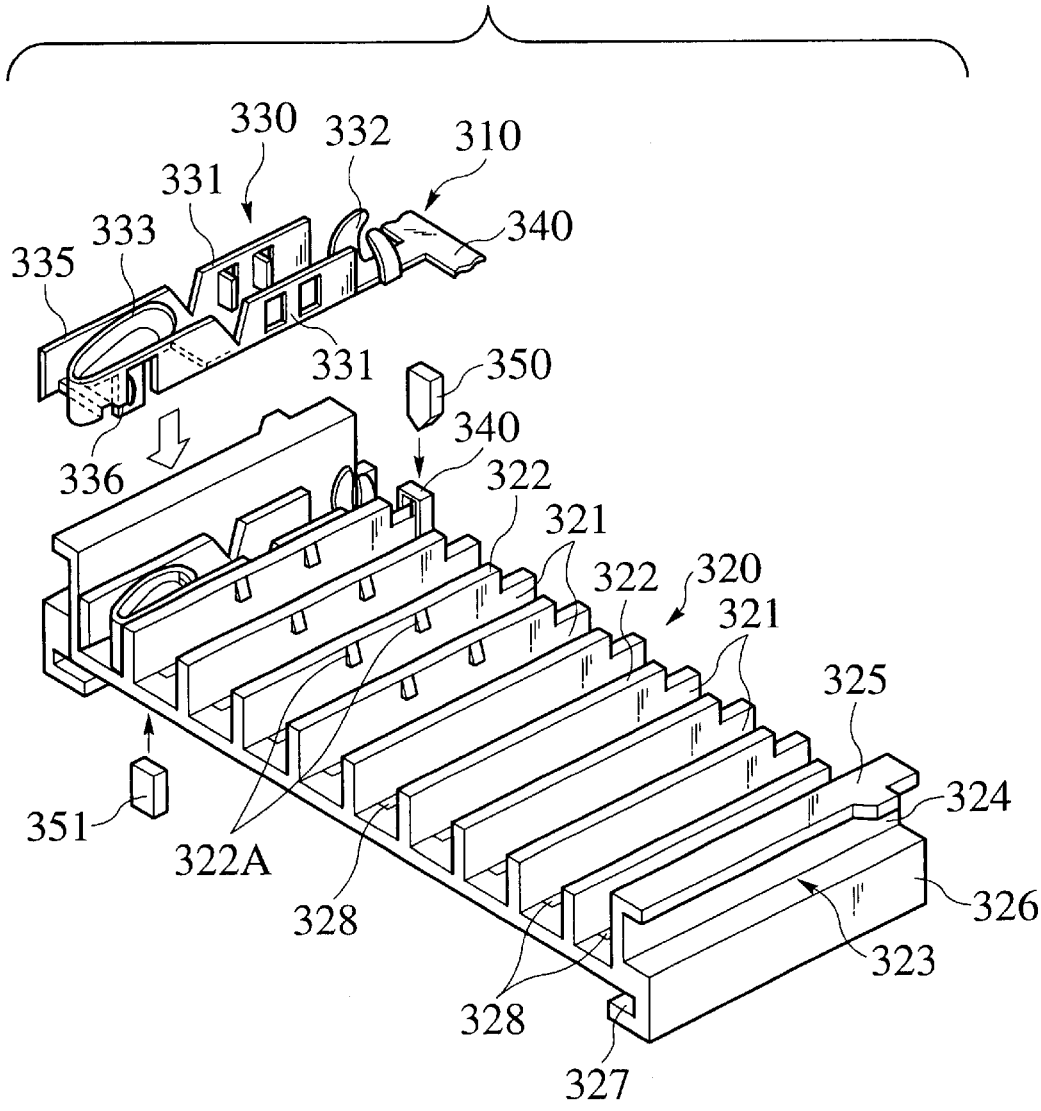
FIG. 21 is an exploded perspective view illustrating a module of the third embodiment.

As illustrated in FIG. 21, accommodation grooves 321 partitioned by partition walls 322 and arranged in parallel are formed in a housing 320 made of insulation resin material. Each accommodation groove 321 corresponds to each terminal 330 belonging to one linkage terminal 310.

Regarding a pair of parallel outside walls 323 of the housing 320, a slide groove 324 and a slide piece 325 are formed on an upper portion of each outside wall 323. A slid jetty 326 is formed at a lower portion of the outside wall 323. The slid jetty 326 is slidably received in a slide groove 324 of another housing 320. An inside slide groove 327 is formed inside the slide jetty 326. A slide piece 325 of still another housing 320 is slidably received in the inside slide groove 327.

A plugging-in hole 328 in which a connecting plugging-in piece 336 described later is inserted is formed in a bottom portion of each accommodation groove 321 positioned on a front end side. Engaging protrusions 322A for engagement of the terminal 330 are formed on an upper portion of each partition wall 322.

Figure 19:
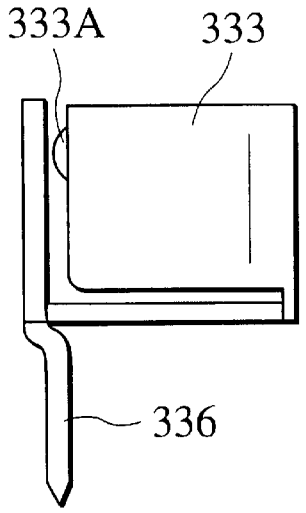
FIG. 19 is a perspective view illustrating a third embodiment of the joint connector according to the invention.

A pair of wire press-fitting plates 331, 331 erected from both side portions of the terminal 330 are disposed in an intermediate portion, in a longitudinal direction, of the terminal 330. Wire press-contacting pieces 331A, 331A are erected in a cut manner from the wire press-fitting plate 331. Bending pieces 332 erected from both side portions of the terminal 330 are formed at an intermediate portion between the wire press-fitting plates 331 and the carrier 340. A bent spring (wound spring) 333 serving as a portion to be connected such as illustrated in FIGS. 18 and 19 is formed at nearer to a distal end side than the wire press-fitting plates 331.

The bent spring 333 has a shape where a front end side of a standing side wall 334 of the terminal 330 is bent back rearward. A protrusion 333A is formed at a portion of the bent spring 333 contacting with the other standing side wall 335. A plugging-in piece 336 for connection serving as a connecting portion and projecting downward is formed at a lower portion of the other standing side wall 335 of the terminal 330. A slit 336A engaged with the protrusion 333A of the bent spring 333 is formed in the plugging-in piece 336.

A notch 334A is formed in the plugging-in piece 336 of the standing side wall 334. When the plugging-in piece 336 is not used for connection, the plugging-in piece 336 is bent to be accommodated in the notch 334A.

Figure 20:
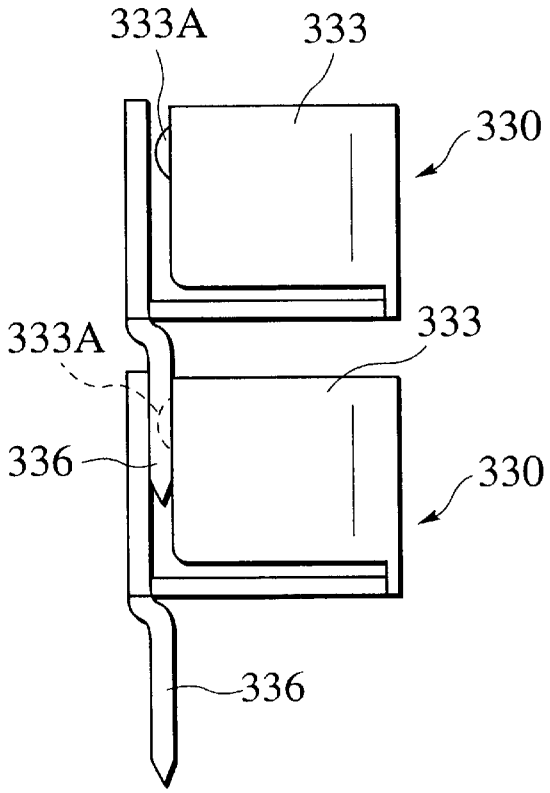
FIG. 20 is a front view illustrating a state where terminals of the third embodiment have been connected to each other.

In order to connect the terminals 330 thus structured to each other, the plugging-in piece 336 of the upper terminal 330 is slid on the lower terminal 330 from a front of the lower terminal 330 rearward, as illustrated in FIG. 18. Thereby, the connection of the terminals 330 is performed by plugging the plugging-in piece 336 in between the bent spring 333 and the standing side wall 335, as illustrated in FIG. 20.

At this time, the protrusion 333A of the bent spring 333 is fitted into the slit 336A of the plugging-in piece 336. FIG. 21 illustrates a state where the linkage terminal 310 is mounted in the housing 320. As illustrated in FIG. 27, the linkage terminal 310 cut out so as to include a predetermined number of the terminals 330 is mounted in the housing 320 and cutting off of the carrier 340 and/or bending of the plugging-in piece 336 for connection is performed according to a circuit configuration required. Reference numeral 350 in FIG. 21 is a cutting jig for cutting the carrier 340, and reference numeral 351 is a bending jig for bending the plugging-in piece 336 for connection.

Figure 22:
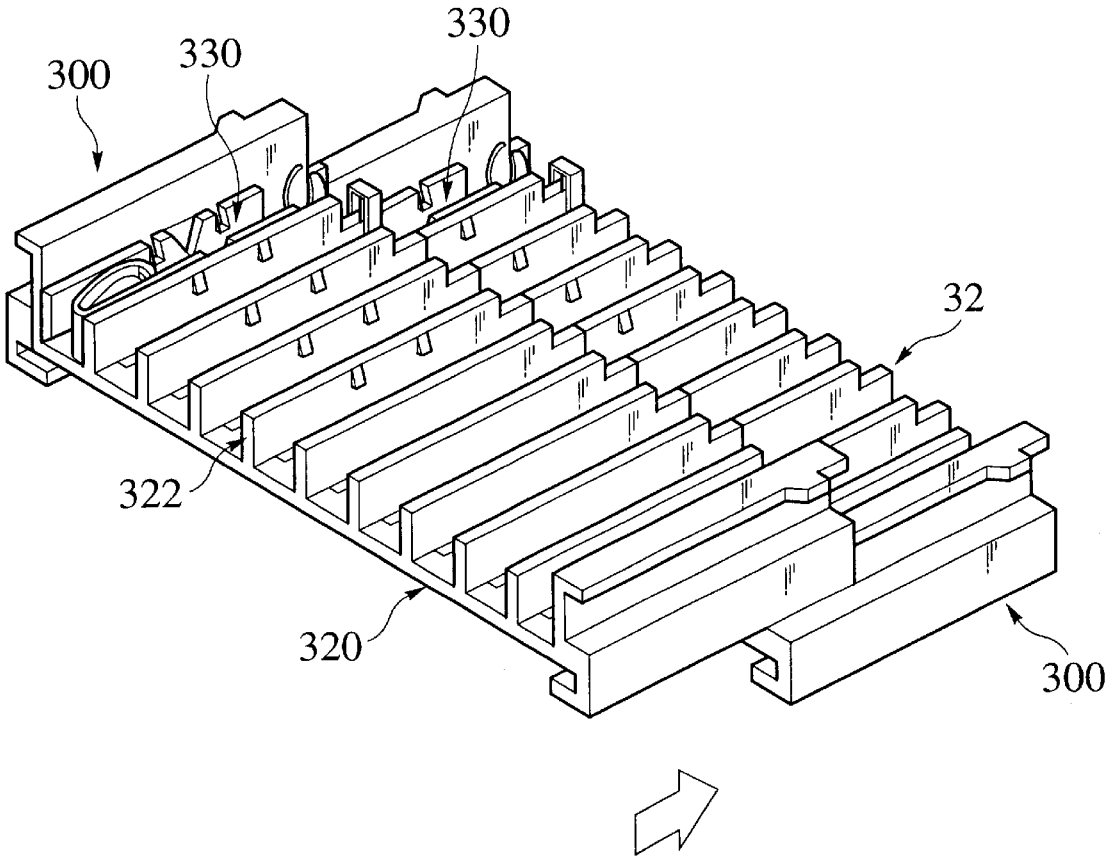
FIG. 22 is a perspective view illustrating how to assemble modules in the third embodiment.

When a predetermined number of the modules 300 each having the housing 320 in which the linkage terminal 310 is mounted are stacked one on another for connection, the upper side module 300 is fitted and slid in the lower side module 300 from a front end side of the lower side module 300, as illustrated in FIG. 22.

According to such operations, the plugging-in piece 336 projecting downward from the housing 320 of the upper side module 300 is plugged in between the bent spring 333 and the standing side wall 335 of the terminal 330 of the lower side module 300 to be electrically connected to the terminal 330 of the lower side module 300.

In this embodiment, as illustrated in FIG. 22, connection of the upper side and lower side terminals 330 is performed by inserting the plugging-in piece 336 of the upper side terminal 330 moved from the front of the lower side terminal 330 rearward (in a direction indicated with a thick arrow in FIG. 28) to the bent spring 333 of the lower side terminal 330. Accordingly, the plugging-in piece 336 can be plugged in more securely than a method where a plugging-in piece is plugged in a vertical direction. In this embodiment, also, as a connection is performed in a sliding manner, no side wall is required at a front end of the housing 320 so that a housing structure can be made simple.

In the above, the respective embodiments have been explained, but the present invention is not limited to these embodiments. A various kinds of design modifications can be effected within the scope and the gist of the present invention. For example, in the above first embodiment, the linkage terminal 110 where the two linkage terminals 110A, 110B have been stacked and welded has been employed, but the present invention is not limited to this terminal 110.

What is claimed is:

1. A joint connector, comprising:

a plurality of vertically stackable housings; and a plurality of mutually connectable electrically conductive terminals, each of which is sized and configured to be accommodated in any one housing, each terminal including an upwardly extending connecting portion and a downwardly depending connecting portion, the downwardly depending connecting portion of any one terminal sized and configured to physically and electrically connect with the upwardly extending connecting portion of another terminal, at least one of the upwardly extending and downwardly depending connecting portions being bendable in a transverse direction;

wherein at least one upper terminal is accommodated in an upper housing of the vertically stackable housings and at least one lower terminal is accommodated in a lower housing of the vertically stackable housings; and wherein at least a selective upper terminal and at least a corresponding selective lower terminal are not electrically connected when either the upwardly extending connecting portion of the selective lower terminal or the downwardly depending connection portion of the selective upper terminal is substantially bent in the transverse direction so as to provide a specific circuit configuration.

2. A joint connector according to claim 1, wherein the terminals are integrally formed in a linkage terminal having a multi-continuous shape, which is cut out from a conductive mother plate.

3. A joint connector according to claim 2, wherein the linkage terminal includes a strip-shaped carrier performing a coupling between the terminals and a front end portion direction of the terminal to be bent back, wherein the upwardly extending connecting portion is disposed at a distal end of the front end portion and erected from the bent-back front end portion.

4. A joint connector according to claim 1, wherein the downwardly depending connecting portion is constituted with a connecting plate, and the upwardly extending connecting portion is constituted with spring pieces sandwiching the downwardly depending connecting portion therebetween.

5. A joint connector according to claim 1, wherein each housing has openings, the downwardly depending connecting portion in one housing respectively passing through the openings of the one housing, and each housing has protection walls formed at peripheral edges of the openings and projecting below the downwardly depending connecting portions which pass through the openings, the protection wall of the upper housing being opposed to the bent upwardly extending connecting portion of the lower terminal.

6. A joint connector according to claim 1, further comprising engaging means for holding the housings in a state where the housings are stacked at the predetermined position.

7. A joint connector according to claim 1, wherein each terminal has wire holding pieces for holding the wire, and the wire holding pieces being arranged at both side portions of the terminals so as to be shifted in a longitudinal direction of each terminal.

8. A joint connector according to claim 1, wherein another upper terminal is accommodated in the upper housing of the vertically stackable housings and another lower terminal is accommodated in the lower housing of the vertically stackable housings, and wherein neither the upwardly extending connecting portion of the another lower terminal or the downwardly depending connecting portion of the another upper terminal is substantially bent in the transverse direction so that electrical connection between the another upper and lower terminals is achieved.

9. A joint connector, comprising:

an upper housing vertically stacked upon a lower housing; and upper and lower linkage terminals respectively accommodated in the upper and lower housings, each linkage terminal including conductive terminals each being connected with a wire and coupling portions between the terminals, each linkage terminal further including an upwardly extending connecting portion and a downwardly depending connecting portion, the downwardly depending connecting portion of an upper linkage terminal being sized and configured to physically and electrically connect with the upwardly extending connecting portion of a lower linkage terminal, each upwardly extending connecting portion of each lower linkage terminal being bendable in a transverse direction;

wherein at least a selective upper linkage terminal and at least a corresponding selective lower linkage terminal are not electrically connected when the upwardly extending connecting portion of the selective lower linkage terminal is substantially bent in the transverse direction so as to provide a specific circuit configuration.

10. The joint connector according to claim 9, wherein, for another upper linkage terminal and another lower linkage terminal, the upwardly extending connecting portion of the another lower linkage terminal is not substantially bent in the transverse direction so that electrical connection between the another upper and lower linkage terminals is achieved.

* * * * *